US006172489B1

(12) United States Patent
Walker

(10) Patent No.: US 6,172,489 B1
(45) Date of Patent: Jan. 9, 2001

(54) VOLTAGE CONTROL SYSTEM AND METHOD

(75) Inventor: N. Edward Walker, Tampa, FL (US)

(73) Assignee: Ultrawatt.com Inc., Fort Myers, FL (US)

( * ) Notice: Under 35 U.S.C. 154(b), the term of this patent shall be extended for 0 days.

(21) Appl. No.: 09/473,345

(22) Filed: Dec. 28, 1999

(51) Int. Cl.[7] ..... G05F 1/10; G05F 1/40
(52) U.S. Cl. ..... 323/237; 323/235
(58) Field of Search ..... 323/235, 237, 323/239, 246, 300, 319, 320; 315/209 R, 227 R, 233, 240, 291

(56) References Cited

U.S. PATENT DOCUMENTS

| | | |
|---|---|---|
| 3,201,597 | 8/1965 | Balan . |
| 3,265,907 | 8/1966 | Kurata et al. . |
| 3,265,930 | 8/1966 | Powell . |
| 3,421,027 | 1/1969 | Maynard et al. . |
| 3,422,309 | 1/1969 | Spira et al. . |
| 3,422,310 | 1/1969 | Widmayer . |
| 3,509,450 | 4/1970 | McNulty . |
| 3,525,882 | 8/1970 | Montague . |
| 3,538,427 | 11/1970 | Ottendorf . |
| 3,638,102 | 1/1972 | Pelka . |
| 3,659,147 | 4/1972 | Widmayer . |
| 3,679,932 | 7/1972 | Murphy . |

(List continued on next page.)

FOREIGN PATENT DOCUMENTS

| | | |
|---|---|---|
| 1276227 | 11/1990 | (CA) . |
| 29 18 015 | 11/1980 | (DE) . |
| 0 200 827 A1 | 11/1986 | (EP) . |
| 0 263 966 A1 | 4/1988 | (EP) . |
| 2 526 244 | 11/1983 | (FR) . |
| 1460006 | 12/1976 | (GB) . |
| 59-95618 | 6/1984 | (JP) . |
| 742-900 * | 6/1980 | (SU) ..... G05F/1/44 |
| WO 88/03353 | 5/1988 | (WO) . |

OTHER PUBLICATIONS

Reverse Phrase–Controlled Dimmer for Incadescent Lighting, Burkhart and Ostrodka, *IEEE Transactions on Industry Applications*, vol. 1A–15, No. 5, Sep./Oct. 1979, pp. 579–588.

Lamp Acoustical Noise and the Reverse Phase Controlled Dimmer, Burkhart and Burtness, *IEEE Transactions on Industry Applications*, vol. 1A–8, No. 1, Jan./Feb. 1972, pp. 84–87.

Power FET Controlled Dimmer for Incandescent Lamps, Christiansen and Benedetti, *IEEE Transaction on Industry Applications*, vol. 1A–9, No. 3, May/Jun. 1983, pp. 323–327.

* cited by examiner

*Primary Examiner*—Matthew Nguyen
(74) *Attorney, Agent, or Firm*—Craig A. Summerfield; Brinks Hofer Gilson & Lione

(57) ABSTRACT

An AC voltage reduction system and method providing highly efficient reduction of utility voltage with minimal electromagnetic interference is provided. The systems and methods may also be used to improve overall facility power factor. The AC voltage provided to a load, such as a group of lighting ballasts connected on a single circuit, is reduced by a controllable switch coupled in parallel with a capacitor between the AC source and the load. The switch is controlled to turn-on when the voltage across the capacitor is very close to zero and turn-off prior to the next zero-crossing of the line current. The turn-off time is selected in an open loop configuration independently of a measured characteristic of load voltage or watts. In order to provide proper operation of gas discharge lighting, the switch is initially turned off just in advance of the AC source current zero-crossing. To reduce the voltage and provide related power savings the turn-off time is gradually moved to a time more prior to the zero-crossing.

30 Claims, 3 Drawing Sheets

U.S. PATENT DOCUMENTS 3,691,452 9/1972 Aguiar .
3,793,577 2/1974 Cramer .
3,821,634 6/1974 Sabolic .
3,872,374 3/1975 Rasmussen .
3,919,592 11/1975 Gray .
3,935,530 1/1976 Tanaka et al. .
4,042,856 8/1977 Steigerwald .
4,099,099 7/1978 Grudelbach .
4,189,644 2/1980 Hirschfeld .
4,234,820 11/1980 Widmayer .
4,255,782 3/1981 Joyce .
4,289,948 9/1981 Jurek et al. .
4,300,075 11/1981 Foose et al. .
4,302,717 11/1981 Olla .
4,350,935 9/1982 Spira et al. .
4,352,045 9/1982 Widmayer .
4,358,716 11/1982 Cordes et al. .
4,359,670 11/1982 Hosaka et al. .
4,369,403 1/1983 Lee .
4,370,601 1/1983 Horii et al. .
4,371,812 2/1983 Widmayer .
4,394,603 7/1983 Widmayer .
4,417,156 11/1983 Fukui et al. .
4,434,358 2/1984 Apfelbeck et al. .
4,447,765 5/1984 Cote .
4,489,264 12/1984 Dabney .
4,507,569 3/1985 Hess, II .
4,542,451 9/1985 Hucker .
4,567,425 * 1/1986 Bloomer ..... 323/237
4,636,619 1/1987 Sugimori .
4,642,525 2/1987 Widmayer .
4,704,570 11/1987 Hopkins .
4,719,402 1/1988 Brennan et al. .
4,733,138 3/1988 Pearlman et al. .
4,766,352 8/1988 Widmayer .
4,804,916 2/1989 Frank .
4,806,838 2/1989 Weber .
4,831,508 5/1989 Hunter .
4,870,340 9/1989 Kral .
4,879,624 11/1989 Jones et al. .
4,912,390 3/1990 Curran, Jr. et al. .
4,933,798 6/1990 Widmayer et al. .
4,956,583 9/1990 Lawrence et al. .
4,956,599 9/1990 Nishizawa et al. .
5,030,890 7/1991 Johnson .
5,038,081 8/1991 Maiale, Jr. et al. .
5,066,896 11/1991 Bertenshaw et al. .
5,237,244 8/1993 Bertnshaw et al. .
5,519,311 5/1996 Widmayer .
5,583,423 12/1996 Bangerter .
5,629,607 * 5/1997 Callahan et al. ..... 323/237
5,652,504 7/1997 Bangerter .
5,754,036 5/1998 Walker .
5,757,168 * 5/1998 De Vale ..... 323/235

VOLTAGE CONTROL SYSTEM AND METHOD

BACKGROUND

This invention relates to the reduction of AC voltage to a load. In particular, the system or method reduces AC utility power provided to a load.

AC utility voltage reduction is conventionally performed using large and heavy step-down AC transformers. Step-down AC transformers operate with about 96% efficiency.

Where miniaturization is desired, a variety of switchmode power supplies and conditioners have been developed, offering much smaller size and weight than conventional power transformers. However, switchmode power controllers operate at efficiencies of around 80–90 percent, much less than the standard transformer. Switch mode power controllers also operate at high frequencies (e.g. 50 kHz and higher) which generates copious amounts of electromagnetic interference (EMI). EMI is reduced by filtering and other techniques.

The use of switchmode power conditioners has been accelerated by government encouragement of the use of power factor controllers (PFCs). PFCs help maintain a high power factor, improving the utility's operating efficiency by reducing losses in power delivery. However, the utility's increase in operating efficiency through the use of switchmode PFCs is offset by the 10–20 percent efficiency loss penalty created by the PFCs.

U.S. Pat. Nos. 5,583,423 and 5,754,036 disclose energy saving power control systems and methods. The closed loop systems disclosed in these patents use the power measured at the load to control circuit functions, providing for efficient power reduction and power factor adjustment.

SUMMARY

The present invention is defined by the following claims, and nothing in this section should be taken as a limitation on those claims. By way of introduction, the preferred embodiment described below includes an AC power regulation system and method providing highly efficient reduction of utility voltage with minimal EMI. The systems and methods may also be used to improve overall facility power factor.

The AC power provided to a load, such as a group of lighting ballasts connected on a single circuit, is regulated by a controllable switch coupled in parallel with a capacitor between the AC source and the load. The switch is controlled to turn-on after a load current zero-crossing and turn-off prior to the next zero-crossing. The turn-off time is selected in an open loop configuration independently of a measured load voltage or power characteristic. In order to provide proper operation of gas discharge lighting, the switch is initially turned off just in advance of the AC source current zero-crossing. To reduce the voltage and related power and provide more power savings, the turn-off time is gradually moved to a time more prior to the zero-crossing.

In one aspect, an AC voltage reduction system for controlling load power to a load has an input for coupling to an AC voltage source and an output for coupling to the load. The voltage reduction system includes a controllable switch coupled in series between the input and the output. A capacitor is coupled in parallel with the controllable switch. Circuitry for turning-on and turning-off the controllable switch to a conducting state and a non-conducting state, respectively, is also provided. Switch control circuitry for generating control signals to control turn-on and turn-off times is operable to select the turn-off time independent of a measured load voltage or power characteristic. Circuitry for ensuring that the turn-off time initially occurs just in advance of a line current zero-crossing point is also provided.

In a second aspect, a method of AC voltage reduction for controlling power to a load in an electrical system is provided. A controllable switch is operated during a first mode of operation such that substantially full voltage is supplied to the load. A voltage reduction mode is initiated. The power supplied to the load is gradually reduced during the voltage reduction mode from a substantially full power to a target value over a period of time. The controllable switch is initially turned-off just in advance of a load current zero-crossing in the voltage reduction mode. The switch is caused to be off prior to the next successive load current zero-crossing and on each following successive load current zero-crossing. The turn-off time of the switch is controlled independent of a measured voltage or power characteristic of the load waveform.

In a third aspect, an AC voltage reduction system for controlling voltage to a load comprises an input for coupling to an AC voltage source and an output for coupling to the load. At least two types of load devices characterized by different impedances are connected with the output. A controllable switch and parallel capacitor are coupled in series between the input and the output. Circuitry and control circuitry for turning-on and turning-off the switch is also provided.

In a fourth aspect, the capacitor provided in parallel with the controllable switch has a capacitance that is proportional to the line current and operable to pass line current during a substantial portion of a half cycle of the line current. Circuitry for turning-on and turning-off the switch and controlling operation of the switch operates independent of a measured voltage or power characteristic of the load current.

Further aspects and advantages of the invention are disclosed below in conjunction with the preferred embodiments.

DETAILED DESCRIPTION OF THE PREFERRED EMBODIMENTS

The AC voltage reduction system of the preferred embodiments includes a capacitor switched AC voltage converter operating at twice the line frequency. Preferably, the AC voltage reduction system operates at an efficiency greater than 99%. The system is connected between a source, such as a utility AC voltage supply, and a load, such as a system of lighting ballasts and/or other loads connected to a switch box. For example, a wall unit comprising the AC voltage reduction system is mounted adjacent to a switch box and connected in series between the load side of the switch box and the ballasts of multiple lights.

Figure 1:
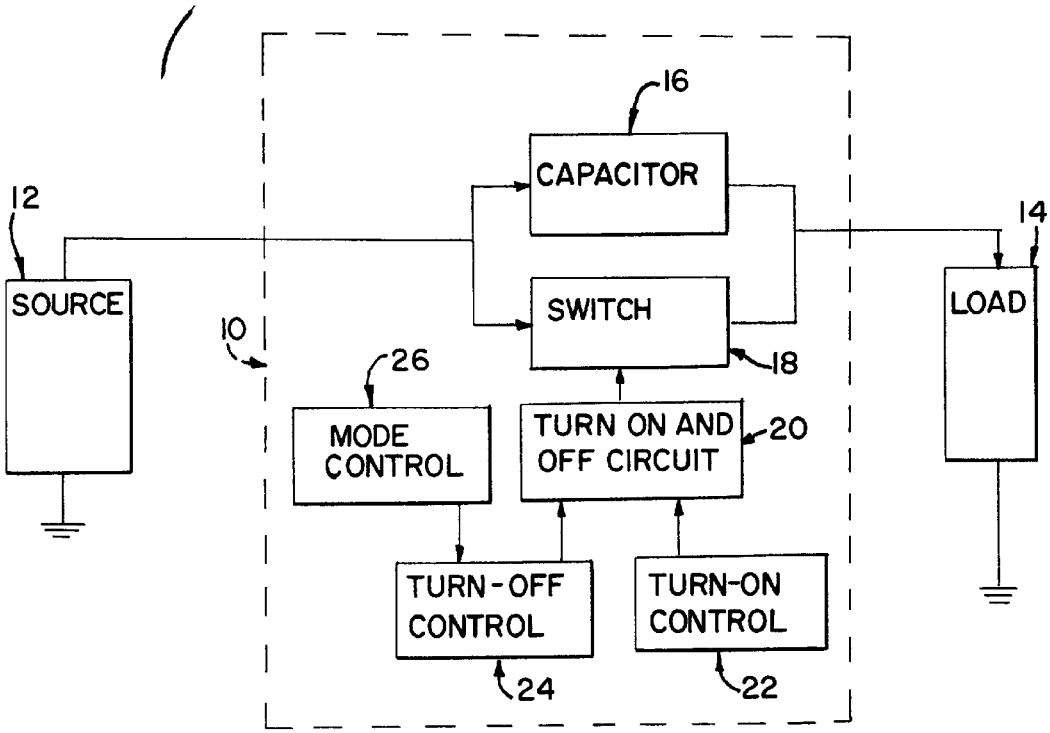
FIG. 1 is a block diagram of one preferred embodiment of an AC voltage reduction system.

FIG. 1 shows an AC voltage reduction system 10 of the preferred embodiment for controlling load power. The system 10 includes a capacitor 16 connected in parallel with a switch 18 between a source 12 and a load 14. A circuit 20 for turning-on and turning-off the switch 18 is controlled by a turn-on control 22 and a turn-off control 24. The turn-off control 24 or a signal provided by the turn-off control 24 is responsive to a mode controller 26. In alternative embodiments, various circuits shown as separate components in FIG. 1 are implemented as a single component. For example, the mode control 26, the turn-off control 24 and the turn-on control 22 are implemented as a single logic device. Additional components other than those shown in FIG. 1 may also be provided as part of the AC voltage reduction system.

The source 12 comprises a source of line voltage, such as provided by a utility, an alternating current generator, a breaker box or circuit panel, a source of direct current with a DC to AC converter or other AC source. The load 14 comprises one or more load devices, such as a lighting load (e.g., halogen, incandescent, ballasted fluorescent, or ballasted high intensity discharge lighting loads), magnetically ballasted loads, or electronic ballasted loads. Other loads, such as motors or transformers, may be provided. The load 14 may comprise single or multiple load devices consisting of a combination of resistive, capacitive, and inductive elements. For example, three or more electrically connected load devices are used in one circuit. In some embodiments, the load 14 comprises multiple different devices, such as two types of lighting loads with different impedances or other characteristics. For example, halogen, incandescent, and ballasted fluorescent lighting loads are provided on a same circuit.

The system 10 alters one or more characteristics of the waveform output by the source 12 and provides the altered waveform to the load 14. For example, the switch 18 is operated to be always on for providing full power to the load 14. To reduce the power, the turn-off time of the switch is initially moved to be just prior to a zero-crossing of the source waveform. To implement additional power reduction and associated savings, the turn-off time is gradually adjusted to a time more prior to the zero-crossing of the source waveform. The capacitor 16 provides a sinewave altered by an exponentially decaying component (i.e. a quasi-sinusoidal voltage waveform) to the load 14 while the switch 18 is turned off, or is not conducting.

The mode control 26 controls operation of the turn-off control 24 for operation in the full power mode, reduction in power mode or continuous operation at a reduced power mode. The mode control 26 is responsive to manual user adjustments, or electronic or processor adjustments, such as photodetector input information, to control the amount of power reduction provided by the system 10. The turn-on control 22 assures that the switch 18 is turned on when the voltage across switch 18 is very close to zero volts.

The system 10 adjusts the effective value of the source voltage downward to achieve a power savings of 20–30% or more while maintaining acceptable harmonic distortion. Magnetically ballasted lighting loads maintain lamp ignition due to voltage crest factor of substantially a same voltage peak provided to the load 14 as is provided by the source waveform 12. The crest factor, a harmonic distortion indicator, of the load current waveform provided by the system 10, generally remains within quality guidelines dictated by various standards, such as ANSI standards. The system 10 also reduces the energy consumed by electronic ballasts. The reduced voltage is adjusted as desired within the input range of the ballast. Preferably, the electronic ballasts used do not automatically compensate for reduced input voltage.

In one preferred embodiment, the system 10 is small and lightweight. The system 10 mounts on a wall or other location and connects between a circuit breaker and one or more load devices without any special wiring connected to any of the separate load devices.

Figure 2:
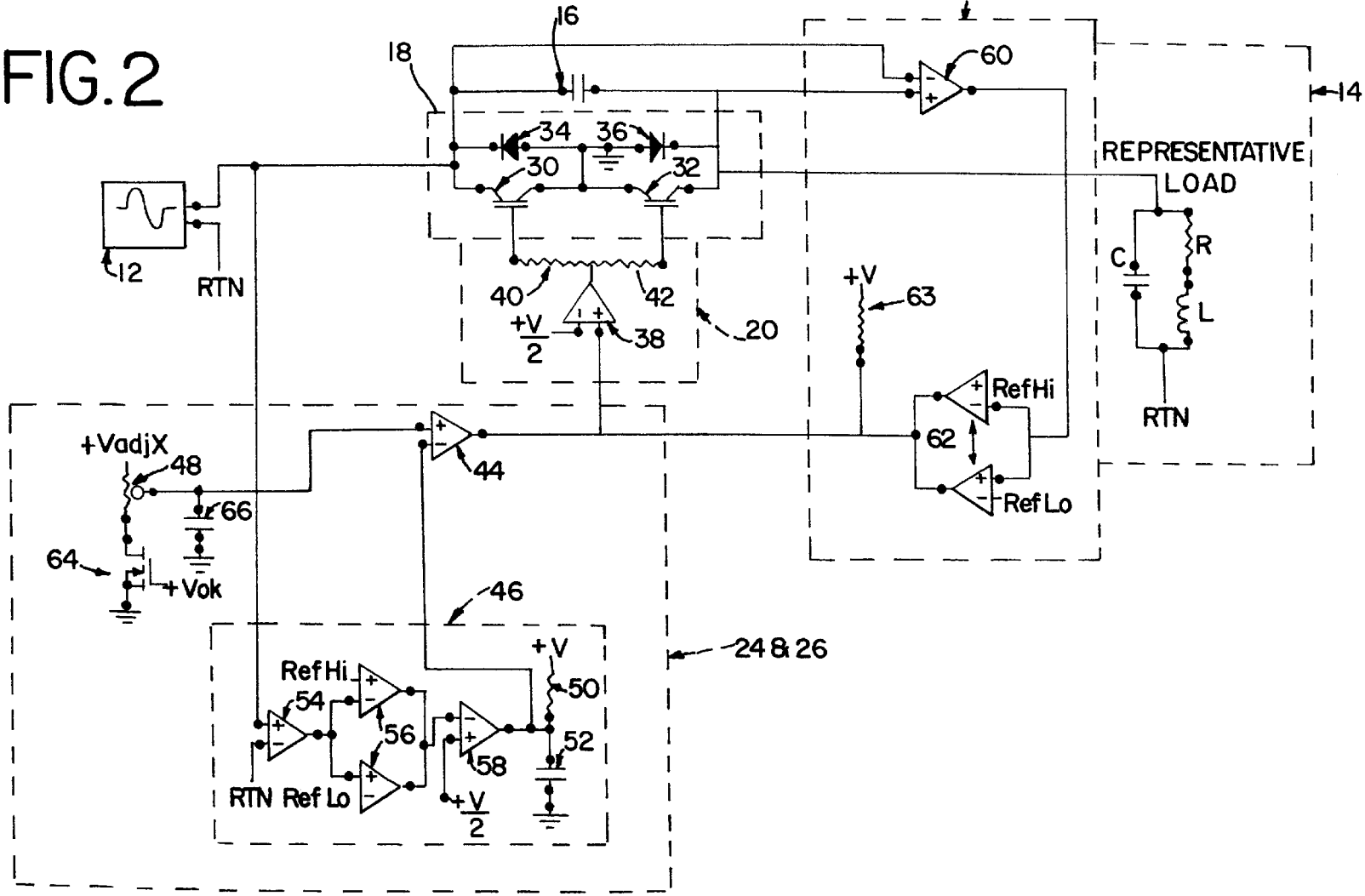
FIG. 2 is a circuit diagram of one preferred embodiment of the AC voltage reduction system of FIG. 1.

FIG. 2 shows a preferred embodiment for implementing various components shown in FIG. 1. The components are represented by the same reference numbers and include the source 12, the load 14, the capacitor 16, the switch 18, the turn-on and turn-off circuit 20, the turn-on control 22, the turn-off control 24, and the mode control 26.

The source 12 is represented by an AC voltage source that provides a sinusoidal waveform, such as a 60 Hz 120 v AC waveform. The load 14 is represented by a complex impedance including a resistance, an inductance and a capacitance. This representation is typical for ballasted lighting loads, such as a plurality of connected lighting ballasts. Other source waveforms and representative loads may be used.

The switch 18 preferably comprises two AC power switches 30 and 32. In one embodiment, the switches 30 and 32 comprise insulated gate bipolar transistors (IGBTs), but field effect transistors (FETs), bipolar transistors, MOS-controlled thyristors (MCTs), silicon controlled rectifiers (SCRs) or a triac may be used, such as by providing additional circuitry for forced commutation. The switch 18 also includes diodes 34 and 36 for reverse breakdown protection of the preferred insulated gate bipolar transistors of the switches 30 and 32. While two switches 30 and 32 are shown, a single switching device may be used, such as a unipolar switch with a full wave bridge rectifier, resulting in a higher voltage drop across the switch 18.

In a preferred embodiment, the switches 30 and 32 are connected in series with the source 12 and the load 14. The emitters of each of the switches 30 and 32 are connected to circuit ground. The base of each switch 30 and 32 is connected to the turn-on and turn-off circuit 20. The collectors of the two switches 30 and 32 are connected to the source 12 and load 14, respectively. Other configurations including additional or fewer circuit components maybe used.

The capacitor 16 has a capacitance that is proportional to the line current and inversely proportional to the line voltage. The value of the capacitor 16 is preferably selected such that its impedance at the line frequency relative to the load impedance is low enough to allow a smooth voltage rise and fall on capacitor 16 over each half-cycle, creating the correspondingly smooth quasi-sinusoidal output waveform, but its impedance is not so large as to prevent appreciable voltage reduction. In one embodiment, for a 60 Hz 277V AC source, the capacitor is 40–100 uF. Preferably, a 60 uF capacitance is used for a load comprising multiple lighting ballasts, but other size capacitances may be used.

The capacitor 16 is coupled in parallel with the switch 18 to efficiently generate the load waveform. The capacitor 16 is operationally inserted in series between the source 12 and the load 14 by turning-off the switch 18 or switches 30 and 32. When the capacitor 16 is operationally inserted and the parallel switch 18 is off the majority of the time, the voltage supplied to the load is reduced. By operating the switch 18 at twice the line frequency and thus inserting the capacitance operationally at twice line frequency, internally generated switching noise is very low, requiring minimal filtering or other measures to control electromagnetic interference.

The capacitance 16 produces a leading power factor. This leading power factor helps control or cancel the lagging power factor commonly found in most facilities.

In alternative embodiments, the capacitance 16 is automatically selectable. For example, the selectable capacitance circuits described in U.S. Pat. Nos. 5,583,423 and 5,754,036, the disclosures of which are incorporated herein by reference, are used. Two or more selectable capacitances are controllably connected as the capacitor 16. By providing selectable capacitance, the range of load impedances accommodated by the system 10 is wider than non-selectable capacitance. In the preferred embodiment discussed above, a single predetermined capacitance is used for simplicity and cost savings, which is suitable for a predetermined range of load amps or watts. Alternately, the system 10 may be designed such that the capacitance 16 is easily manually switched to account for a wider variety of load characteristics when the system 10 is installed.

In yet other alternative embodiments, an inductor is used rather than the capacitor 16. An inductor produces a lagging power factor. Other combinations of inductance and capacitance maybe used. For example, in facilities where several of the systems 10 are used, leading power factor systems using the capacitance 16 and lagging power factor systems using an inductance may be mixed as desired to provide an overall facility power factor. Alternatively, a combination of the capacitor 16 and an inductor or a plurality of capacitors and inductors are used within one system 10 to provide leading or lagging configurations for power factor matching.

The turn-on and turn-off circuit 20 comprises gate driver 38 and resistors 40 and 42 in one preferred embodiment. Different components for driving the switches 30 and 32 of AC power switch 18 may be provided. Such drivers include combinations of discrete components or integrated circuits (ICs). The gate driver 38 preferably comprises a MIC4416 IC, but other drivers may be used. Since the switches 30 and 32 are turned off and on for each half cycle of the line frequency, gate driver 38 provides signals to turn-on and off switch 18 at twice the line frequency. The resistors 40 and 42 control the switching speeds and dampen any switch parasitic oscillations.

The turn-off control 24 comprises a comparator 44, a waveform generator 46, and a reference voltage generator 48. The reference voltage generator 48 preferably comprises a potentiometer that is adjustable pursuant to user control. A timer, photosensor, a logic device, or other device may be used to provide the reference voltage. Optionally, combinations thereof may be used and/or user control over the device may be provided. For example, a photosensor circuit detects the amount of light output in a room and generates a reference voltage inversely proportional to the amount of light being output in a closed loop operation. The reference voltage generated is provided to the comparator 44. For an example of an open loop configuration, a timer circuit generates a reference voltage corresponding to a desired operating point during daylight hours, and a different reference voltage corresponding to a desired operating point during nighttime hours. The reference voltage generated is provided to the comparator 44.

The comparator 44 preferably comprises an open-collector IC, such as an LM339 IC, but other devices such as discrete components or ICs may be used. The comparator 44 compares the reference voltage to a voltage generated by the waveform generator 46. When the waveform generated by the waveform generator 46 is greater than the reference voltage generated by the voltage generator 48, the comparator 44 outputs a signal to the turn-on and turn-off circuit 20, causing the switches 30 and 32 to be turned off.

The waveform generator 46 comprises a resistor 50 and capacitor 52 coupled in series between a positive voltage and ground, a difference amplifier 54 with conventional input scaling resistors (not shown) sensing the source waveform and its return reference (RTN), a window comparator 56 comprising two comparators connected to high and low reference voltages respectively, and a comparator 58. Other waveform generators including additional, different, or fewer circuit components maybe used. The waveform generator 46 preferably generates a sawtooth or other periodic exponential ramping waveforms. The comparator 58 receives inputs from reference +V/2 and the window comparator 56 and connects with the resistor 50 and capacitor 52. The exponentially ramped periodic waveform is generated by current flowing through the resistor 50 charging the capacitor 52 at the output of the comparator 58.

In operation, the difference amplifier 54 applies a scaled source waveform to the inputs of the window comparator 56. When the source voltage waveform is near a zero-crossing, the difference amplifier 54 outputs a voltage close to +V/2. Preferably, the high and low reference voltages for the window comparator 56 are close to +V/2 volts. The output of the window comparator 56 pulses high during each zero-crossing interval. The high pulse is inverted by the comparator 58. The inverted pulse discharges the capacitor 52, resetting the periodic exponential ramp waveform to zero.

By comparing the reference voltage from the voltage generator 48 to the waveform generator 46, the system 10 operates in an open loop. The turn-off time and the associated voltage reduction is determined independently of any measured characteristics of the load waveform, providing a simple implementation with inexpensive circuitry.

The turn-on control 22 comprises a difference amplifier 60, a window comparator 62 and a resistor 63. Resistor 63 is also used as the pull-up resistor for open-collector comparator 44. Preferably, the difference amplifier 60 comprises an operational amplifier with conventional input scaling resistors (not shown), with the negative input connected to the source 12 and the positive input coupled to the load 14. Different, additional or fewer circuit components may be used to control turning-on of the switch 18 in response to a zero-crossing of the source-to-load waveform. The output of the difference amplifier 60 is connected to a negative input and a positive input of two comparators comprising window comparator 62. High and low reference voltages are also input to the window comparator 62. The output of the window comparator 62 connects with the resistor 64, the turn-on and off circuit 20, and turn-off control 24. The resistor 64 also connects with a positive voltage.

The turn-on of the switch 18 is initiated by the turn-on control 22 independently of the turn-off control 24. The difference amplifier 60 provides a scaled line-load voltage waveform as an input to the window comparator 62. The high and low reference voltages are set close to +V/2 volts, so that the output pulses high when the scaled line-load voltage is close to zero. The high pulse causes the turn-on and turn-off circuit 20 to turn-on the switch 18. The output of the window comparator 62 may be held low by the output of the comparator 44 of the turn-off control 24. Since the exponential periodic waveform produced by the waveform generator 46 is reset prior to the line-load voltage reaching zero as a function of the source voltage as modified by system action, the window comparator 62 is allowed to operate unimpeded by the turn-off control 24.

The mode control circuit 26 comprises a bias voltage $V_{adjx}$, a switch 64 and a capacitor 66. The bias voltage $V_{adjx}$ comprises a transformed DC voltage or a source of DC voltage set such that the rising periodic exponential ramping waveform created by the waveform generator 46 intersects with the bias voltage a small time interval prior to the zero-crossing of the source waveform. Where the reference voltage generator 48 comprises a potentiometer, the bias voltage is set to cause the intersection when the potentiometer tap is set to the highest voltage. Preferably, the leading time interval is 1–2 milliseconds for a 60 Hz AC source, but other time intervals may be provided. This leading time is small enough such that essentially full voltage is applied to the load, and large enough such that proper initial timing of switch 18 is assured.

The switch 64 comprises an n-channel field effect transistor, but other switching devices as described herein may be used. The switch 64 is controlled by a voltage signal $V_{ok}$. $V_{ok}$ is preferably provided by a low voltage reference integrated circuit, another analog circuit and/or a logic device. $V_{ok}$ is held low, turning off the switch 64 until the power supplies of the system 10 have stabilized. When switch 64 is off, bias voltage $V_{adjx}$ also acts as the reference voltage, which results in essentially full output voltage being applied to the load. After stabilization as determined based on a measurement, time or event occurrence, $V_{ok}$ is increased, turning on the switch 64 and allowing the reference voltage generator 48 to operate pursuant to the reduced power mode as described below. Preferably, for lighting systems the system 10 stabilizes for about 1 to 2 minutes, but shorter or longer warm-up time periods may be provided.

The capacitor 66 comprises a smoothing capacitor. The capacitor 66 smoothes the transition from the initial full voltage reference voltage to the adjusted reduced voltage reference voltage. The system 10 is transitioned from full voltage to reduced voltage. In one embodiment, the transition between the full voltage and reduced voltage modes occurs in about 0.5 seconds. Other devices for transitioning the system 10 may be used, such as logic devices.

For providing full voltage to the load 14, the mode control 26 causes the output of the comparator 44 to turn-off the switches 30 and 32 near the line current zero-crossing, as determined by bias voltage $V_{adjx}$. In order to operate at a voltage reduction mode, the mode control 26 allows operation of the turn-off control 24 as determined by the reference voltage normally provided by reference voltage generator 48. In order to smoothly switch from the full voltage mode to the voltage reduction mode, the transition from bias voltage $V_{adjx}$ to the normal reference voltage is smoothed by capacitor 66.

Various alternatives to one or more of the components represented in FIG. 2 are possible. For example, a close loop system where the turn-off time is determined as a function of a measured characteristic of the load waveform may be used. Such systems are disclosed in U.S. Pat. Nos. 5,754,036 and 5,583,423, the disclosures of which are incorporated herein by reference. In other alternatives, the difference amplifiers and comparator functional blocks described herein may comprise logic devices, integrated circuits, a collection of discrete components or a combination of both. Preferably, the comparators described above have open collector outputs where the outputs may be tied together for a logic simplification. Any comparator output in a low state holds all other comparator outputs in the group low and conversely all comparator outputs in the group are high if none of the comparator outputs in the group are low. Other types of comparators may be used with appropriate logic circuit modifications. The comparators preferably have hysterisis resistors (not shown) to ensure sharp output transitions. Any of various known circuits for providing low voltage power, low and high voltage references and other bias voltages maybe used to translate a voltage from any source, such as high voltage DC or AC signals, to values suitable for the low voltage control circuitry of the system 10. In alternative embodiments, the gradual reduction in voltage and change in turn-off time is implemented through logic control of the reference voltage.

Figure 3:
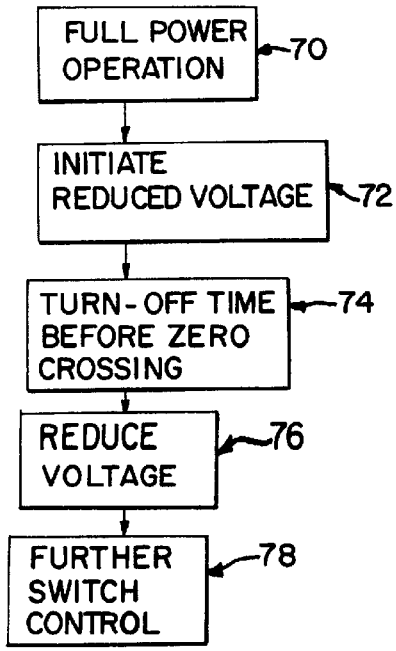
FIG. 3 is a flow chart representing one preferred embodiment of the operation of an AC voltage reduction system.

FIG. 3 is one preferred embodiment of a flow chart representing operation of the system 10 of FIGS. 1 and 2. For full voltage operation represented by block 70, the source waveform 12 is essentially fully applied to the load 14. The switch 18 is always on (except for a small time interval near the line current zero-crossing as determined by $V_{adjx}$ in the mode control 26), so the voltage applied to the load is essentially the same as the voltage to the source less any on-state voltage drop through the switch 18. For many lighting loads, when voltage reduction is initiated, the initial load waveform is preferably substantially the same as the source waveform to avoid large transients and unstable performance. For example, the initial turn-off time is set to be within a quarter cycle before the zero-crossing. Preferably, the turn-off time is slightly before the zero-crossing, as described previously.

Reduced voltage is initiated as represented by block 72 by decreasing the on-time duty cycle of the switch 18. Decreasing the on-time duty cycle places the capacitor 16 in series with the load during the time intervals when the switch 18 is off, reducing the load voltage. The transitions from the on to the off state of the switch 18 are smoothed by the capacitor 16, resulting in a quasi-sinusoidal output waveform as discussed below. To reduce the voltage, the turn-off time is set to be just before a line current zero-crossing as represented by block 74 under the control of the mode control 26. Mode control 26 causes the turn-off time to gradually be more in advance of the zero-crossing as described above.

For operation at the reduced voltage as represented by block 76, the turn-off time and other control of the switch 18 is handled independently of the mode control 26 (i.e., operated in the "run" mode of mode control 26, whereas previously switch 18 was operating in the "start" mode of mode control 26) as represented by the further switch control block 78. The turn-off time is determined by the turn-off control 24. When the exponentially ramped periodic waveform voltage generated by the waveform generator 46 becomes higher than the reference voltage, the output of the comparator 44 switches to a low state. When the comparator 44 switches to a low output state, the gate driver 38 turns off the switches 30 and 32. The exponentially ramped periodic waveform is synchronized to the line frequency and starts to rise at the beginning of every line voltage half cycle zero-crossing. The turn-off time is controlled by adjustment or setting of the reference voltage by the reference voltage generator 48. If the reference voltage is set too high for an intersection to occur before the exponentially ramped periodic waveform is reset, then the switch 18 remains on throughout each half-cycle. However, as described previously, in many lighting systems it is advantageous to ensure that at least a very small turn-off time always occurs, so a bias voltage may be used to ensure that the periodic waveform always intersects the reference voltage. As the reference voltage is reduced, the turn-off time of the switch 18 is more and more in advance of the line current zero-crossing point.

When the switch 18 is turned off, the current from the sourced 12 to the load 14 passes through the capacitor 16.

The capacitor 16 effectively integrates the current, creating a smooth voltage build-up across the capacitor which subtracts from the output voltage. As a result, the voltage across the capacitor 16 increases and the voltage delivered to the load 14 decreases. As the current through the capacitor 16 changes polarity during the half-cycle, the voltage across the capacitor 16 peaks and begins to fall towards zero. When the voltage across the capacitor 16 is close to zero, the switch 18 is turned on. Attempting to turn-on the switch 18 when the voltage across the capacitor 16 is appreciable may result in high energy discharge from the capacitor 16 which may be inefficient and destructive. When the voltages are close to zero as determined by being between the high and low reference voltages, the window comparator 62 output switches to a high state. Switching to the high state initiates a turn-on voltage by the gate driver 38. Turning-on the switches 30 and 32 clamps the load voltage to close to zero. The switches 30 and 32 are effectively latched into the on-state until the next turn-off signal from the comparator 44 is provided, which overrides the turn-on signal from the comparator 62.

The system 10 operates to reduce voltage provided to the load 14. The switch 18 is turned on at each zero-crossing of the line-load waveform and turned off independently of any load waveform characteristics at a point before the next line current zero-crossing of the source waveform. Earlier turn-off times within half-cycles or between zero-crossings result in more voltage reduction.

Figure 4:
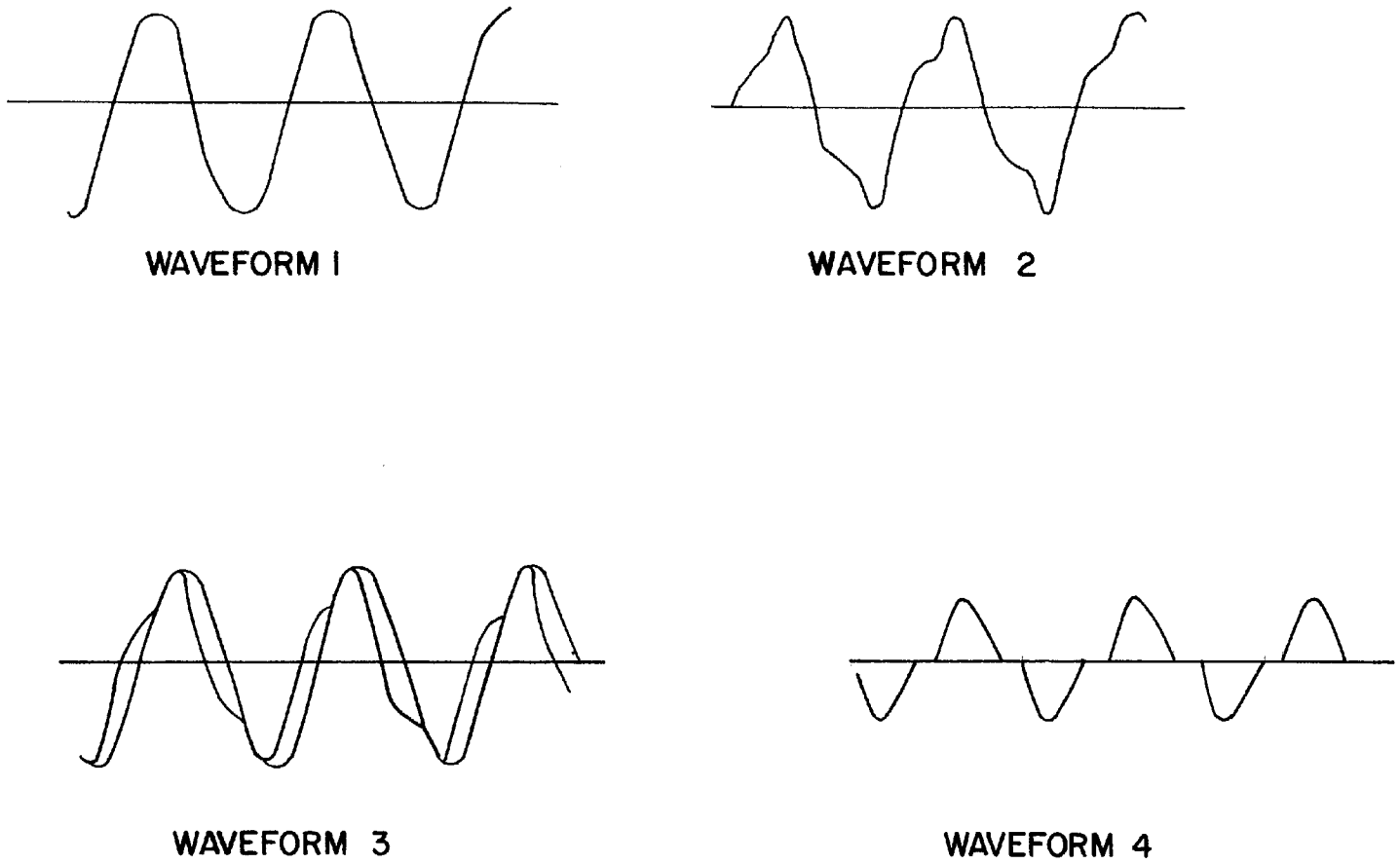
FIG. 4 is a graphical representation of waveforms at the source and at the load of FIG. 1.

FIG. 4 shows Waveforms 1 through 4 that represent measurements taken during testing of an embodiment of the system 10 operating at a line voltage of 277 VAC with a resistive load, and with the unit operating at a power savings of approximately 25%. Waveform 1 shows the line voltage, from line to neutral.

Waveform 2 shows the load voltage, from load to neutral. Waveform 2 has a continuing voltage across the load, with current flowing through the load via capacitor 16 during the intervals when switch 18 is turned off. The load waveform has the same frequency as the source waveform. As represented by Waveform 2, the load waveform created by the system 10 is a quasi-sinusoidal waveform.

Waveform 3 shows the line Waveform 1 and load Waveform 2 superimposed, demonstrating that the quasi-sinusoidal load Waveform 2 has about the same or slightly smaller peak value, a lower effective (RMS) value, and a moderately higher crest factor (i.e., ratio of peak voltage to RMS voltage) than the source Waveform 1. As can be seen, the load Waveform 2 has a lower RMS value because of the exponentially-shaped "slices" removed from the sides of the source Waveform 1 by system action.

For most loads 14, such as lighting loads, the quasi-sinusoidal load Waveform 2 provides reduced effective AC voltage, allowing energy consumption by the load to be reduced or regulated as desired. Where the amount of power reduction is controlled by the user, the lower voltage RMS value is adjusted in response to the user control, such as by adjusting the potentiometer.

Waveform 4 shows the voltage across the switch 18, or the line-load waveform. The flat portion of Waveform 4 is the time in which the switch 18 is conducting. The remainder of the Waveform 4 represents the voltage across the capacitor 16. The times where Waveform 4 approaches the flat spots represents the switch turn-on times near the line-load zero voltage points. The times where Waveform 4 initially departs from the flat spots represents the switch turn-off times prior to the next line current zero-crossing within a half cycle of the source waveform.

The system 10 operates at a high efficiency, such as 99% efficiency. The table below represents various efficiency tests performed on the system 10 using a 277 VAC 60 Hz source waveform and a resistive load of nominally 4.3 amps at no voltage reduction.

| Savings | Input | Output | Efficiency |
|---|---|---|---|
| 10% | 1043 w | 1031 w | 98.8% |
| 15% | 981 w | 973 w | 99.2% |
| 20% | 923 w | 917 w | 99.4% |
| 25% | 865 w | 860 w | 99.4% |
| 30% | 808 w | 802 w | 99.3% |

The system 10 comprised the system described above in FIG. 2 using the resistance and capacitive values listed in the attached Appendix A.

While the invention has been described above by reference to various embodiments, it will be understood that many changes and modifications can be made without departing from the scope of the invention. For example, different circuit components may be used. Different turn-on and turn-off times may be used in combination to reduce the voltage and may be further selected as a function of different components. The load waveform generated by the system 10 may be altered as a function of the different turn-off and turn-on times as well as different selected capacitance values.

It is thereof intended that the foregoing detailed description be understood as an illustration on the presently preferred embodiments of the invention, and not as a definition of the invention. It is only the following claims, including all equivalents, that are intended to define the scope of the invention.

APPENDIX A

| | |
|---|---|
| Capacitor 16 | 60 μf |
| resistor 40 | 18 ohms |
| resistor 42 | 18 ohms |
| potentiometer 48 | 100 kohms |
| resistor 50 | 50 kohms |
| capacitor 52 | 0.15 μf |
| resistor 63 | 100 kohms |
| capacitor 66 | 1 μf |
| Vadjx | +8 V |
| RefHi | +4.2 V |
| RefLo | +3.8 V |

What is claimed is:

1. An AC voltage reduction system for controlling load voltage to a load, said voltage reduction system having an input for coupling to an AC voltage source and having an output for coupling to the load, said voltage reduction system comprising:

a controllable switch coupled in series between the input and the output;

a capacitor coupled in parallel with the controllable switch;

circuitry for turning-on the controllable switch to a conducting state;

circuitry for turning-off the controllable switch to a non-conducting state; and switch control circuitry for generating control signals to control said circuitry for turning-on and said circuitry for turning-off such that the controllable switch is turned on to a conducting state at a selected turn-on time, and is turned off to a non-conducting state at a selected turn-off time prior to a line current zero-crossing point, said switch control circuitry operable to select said turn-off time independent of a measured load voltage or power characteristic; and circuitry for ensuring that said turn-off time initially occurs just in advance of a line current zero-crossing point.

2. The system of claim 1 wherein the capacitance comprises at least 40 uF.

3. The system of claim 1 further comprising a user input wherein the switch control circuitry is operable to select said turn-off in response to the user input.

4. The system of claim 1 wherein the switch control circuitry is operable to change the turn-off time from the initial time to a power savings time, the power savings time comprising a time prior to the line current zero-crossing point.

5. The system of claim 4 wherein the change in the turn-off time is gradual.

6. The system of claim 1 wherein the system operates at greater than 99% efficiency.

7. The system of claim 1 wherein the selected turn-off time comprises operation of the system in a power savings mode.

8. The system of claim 7 wherein a load waveform at the load during operation in the power savings mode has a quasi-sinusoidal wave shape with a higher ratio of a peak amplitude to an RMS voltage than a source waveform at the source.

9. The system of claim 8 wherein the load waveform and the source waveform are characterized by a substantially same frequency.

10. The system of claim 1 wherein the load comprises a combination of resistive, capacitive, and inductive impedances.

11. The system of claim 1 wherein the load comprises at least two devices characterized by different impedances.

12. The system of claim 1 wherein control independent of the measured characteristic of the load voltage or power comprises control in response to an open loop configuration.

13. The system of claim 1 wherein the switch control circuitry is operable to turn-on and off the switch at twice a frequency of a source waveform.

14. The system of claim 1 wherein the capacitor provides a leading power factor.

15. The system of claim 1 wherein the switch control circuitry is operable to select the turn-off time in response to at least one of a timer, a photo-detector and a potentiometer.

16. A method of AC voltage reduction for controlling voltage to a load in an electrical system, said voltage reduction system having an input for coupling to an AC voltage source and an output for coupling to the load, and having a controllable switch coupled in series between said input and said output, comprising the acts of:

(a) operating said controllable switch during a first mode of operation such that substantially full voltage is supplied to said load;

(b) initiating a voltage reduction mode after said first mode;

(c) gradually reducing the voltage supplied to said load during said reduction mode from said substantially full voltage to a target value over a period of time;

(d) initially turning-off said controllable switch just in advance of a load current zero-crossing point in said voltage reduction mode;

(e) causing the switch to be in an off condition prior to the next-successive load current zero-crossing and causing the switch to be in an on condition following said next-successive load current zero-crossing; and (f) controlling a turn-off time of the switch independent of a measured characteristic of a load waveform.

17. The method of claim 16 further comprising:

(g) providing a capacitor in parallel with said controllable switch.

18. The method of claim 17 wherein (g) comprises providing a leading power factor.

19. The method of claim 16 further comprising:

(g) controlling the turn-off time as a function of a user input.

20. The method of claim 16 wherein the system operates at greater than 99% efficiency.

21. The method of claim 16 further comprising:

(g) generating a load waveform at the load during operation in the power savings mode comprising a quasi-sinusoidal wave shape with a higher ratio of a peak amplitude to an RMS voltage than a source waveform at the source.

22. The method of claim 21 wherein the load waveform and a source waveform are characterized by a substantially same frequency.

23. The method of claim 16 further comprising regulating the power to the load comprising at least three devices.

24. The method of claim 16 further comprising regulating the power to the load comprising at least two devices having different impedances.

25. The method of claim 16 wherein (e) comprises turning-on and off the switch at twice a frequency of a source waveform.

26. An AC voltage reduction system for controlling load voltage to a load, said voltage reduction system comprising an input for coupling to an AC voltage source and having an output for coupling to the load, said voltage reduction system comprising:

at least two types of load devices characterized by different impedance connected with the output;

a controllable switch coupled in series between the input and the output;

a capacitor coupled in parallel with the controllable switch;

circuitry for turning-on the controllable switch to a conducting state;

circuitry for turning-off the controllable switch to a non-conducting state; and switch control circuitry for generating control signals to control said circuitry for turning-on and said circuitry for turning-off such that the controllable switch is turned on to a conducting state at a selected turn-on time, and is turned off to a non-conducting state at a selected turn-off time prior to a load current zero-crossing point.

27. An AC voltage reduction system for controlling load voltage to a load, said voltage reduction system having an input for coupling to an AC power source and having an output for coupling to the load, said voltage reduction system comprising:

a controllable switch coupled in series between the input and the output;

circuitry for supplying capacitance coupled in parallel with the controllable switch, the capacitance being proportional to the line current and operable to pass the line current during a substantial portion of a half cycle of the line current;

circuitry for turning-on the controllable switch to a conducting state;

circuitry for turning-off the controllable switch to a non-conducting state; and switch control circuitry for generating control signals to control said circuitry for turning-on and said circuitry for tuning-off such that the controllable switch is turned on to a conducting state at a selected turn-on time, and is turned off to a non-conducting state at a selected turn-off time prior to a line current zero-crossing point, said turn-off time being selected by said switch control circuitry independent of a measured characteristic of the load voltage.

28. The system of claim 27 wherein the capacitance comprises at least 40 uF.

29. The system of claim 27 further comprising circuitry for ensuring that said turn-off time initially occurs just in advance of a line current zero-crossing point.

30. The system of claim 27 wherein the control independent of the measured characteristic of the load voltage comprises control in response to an open loop configuration.

* * * * *